US010209037B2

(12) United States Patent
Vandoninck

(10) Patent No.: US 10,209,037 B2
(45) Date of Patent: Feb. 19, 2019

(54) HEAT ACCUMULATOR FOR FOG GENERATOR

(71) Applicant: Bandit NV, Opglabbeek (BE)

(72) Inventor: Alfons Vandoninck, Opglabbeek (BE)

(73) Assignee: Bandit NV, Opglabbeek (BE)

( * ) Notice: Subject to any disclaimer, the term of this patent is extended or adjusted under 35 U.S.C. 154(b) by 3 days.

(21) Appl. No.: 15/126,604

(22) PCT Filed: Mar. 20, 2015

(86) PCT No.: PCT/IB2015/052043
§ 371 (c)(1),
(2) Date: Sep. 16, 2016

(87) PCT Pub. No.: WO2015/140761
PCT Pub. Date: Sep. 24, 2015

(65) Prior Publication Data

US 2017/0082407 A1 Mar. 23, 2017

(30) Foreign Application Priority Data

Mar. 21, 2014 (BE) ..... 2014/0194

(51) Int. Cl.
*F41H 9/06* (2006.01)
*F28D 20/02* (2006.01)
*F28D 20/00* (2006.01)

(52) U.S. Cl.
CPC ..... *F41H 9/06* (2013.01); *F28D 20/0056* (2013.01); *F28D 20/02* (2013.01)

(58) Field of Classification Search
CPC ..... F41H 9/06; F28D 17/02; F28D 20/0056; F28D 20/02
USPC ..... 239/13; 422/26, 305
See application file for complete search history.

(56) References Cited

U.S. PATENT DOCUMENTS 2,184,185 A * 12/1939 Gerhold ..... B01D 47/06 261/118
2,423,859 A 7/1947 Karner
2,708,656 A * 5/1955 Fermi ..... G21C 1/00 122/1 R
2,782,158 A * 2/1957 Wheeler ..... F04D 29/606 376/265
2,825,543 A * 3/1958 McCracken, Jr. ... B01D 47/025 239/428
3,050,377 A * 8/1962 Christensen ..... B01J 8/0005 165/146

(Continued)

FOREIGN PATENT DOCUMENTS

DE 2810336 A1 9/1979
EP 1985962 A1 10/2008

(Continued)

OTHER PUBLICATIONS

International Search Report and Written Opinion completed Jul. 1, 2015 pertaining to International Application No. PCT/IB2015/052043 filed Mar. 20, 2015.

*Primary Examiner* — Chee-Chong Lee
(74) *Attorney, Agent, or Firm* — Dinsmore & Shohl LLP

(57) ABSTRACT

The invention provides a heat accumulator (1) for vaporizing fog liquid in a fog generator, the heat accumulator comprising multiple closely contiguous, parallel oriented rods (2) with a diameter of between 0.2 mm and 15 mm.

12 Claims, 5 Drawing Sheets

(56) References Cited

U.S. PATENT DOCUMENTS

| | | | | | |
|---|---|---|---|---|---|
| 3,150,053 | A | * | 9/1964 | Goldman et al. | G21C 1/08 376/285 |
| 3,235,344 | A | * | 2/1966 | Dreyer | B01D 3/32 208/109 |
| 3,270,906 | A | * | 9/1966 | Christensen | F16J 13/02 220/327 |
| 3,488,161 | A | * | 1/1970 | Herp, Jr. | C01C 1/0417 422/148 |

FOREIGN PATENT DOCUMENTS

| | | | |
|---|---|---|---|
| EP | 2259004 | A1 | 12/2010 |
| EP | 2860486 | A1 | 4/2015 |
| WO | WO03001140 | A1 | 1/2003 |
| WO | WO2014102365 | A1 | 7/2014 |

* cited by examiner

HEAT ACCUMULATOR FOR FOG GENERATOR

BACKGROUND TO THE INVENTION

A fog generator for a security application is normally technically based on the principle of vaporizing glycol (the fog liquid). Whereby the vaporized fog liquid is emitted into the "area to be fogged" via an outlet channel and a nozzle and there to immediately condense into a dispersed aerosol-like fog under atmospheric pressure and room temperature. This fog takes away the criminal's sight and disorients the criminal.

Increasing the temperature of the fog liquid from room to vaporizing temperature requires 0.8 to 1 kJ per ml. (depending on the applied formulation of the fog liquid, among others, the water content). The heat flow to the transfer surfaces of the vaporization channels/passages is mainly provided for via thermal conduction. The inlet of a heat accumulator, also known in the technical field as a heat exchanger, is connected to a fog liquid reservoir, whereby this fog liquid is injected into the inlet of the heat accumulator at the desired time (fog emission) by overpressure. This overpressure can be generated by:

a) a mechanical pump and/or potential elastic energy (tensioned spring against a piston)

b) operating pressure by compressed or liquid (vapour pressure propellant) propellant, and/or operating pressure generated by gas as a result of a chemical reaction or chain reaction.

A heat accumulator in a fog generator for a security application is characterized by:

- A component in which heat (joules) is stored by its heat capacity C (eg. steel: ~0.46 J/° C. per g) and/or possibly latent congelation heat of a phase-transition agent (for example, see the heat accumulator described in EP2259004)
- The temperature of the heat accumulator, at least at the outlet, is higher than the boiling point of the fog liquid to be vaporized.
- Heating the heat accumulator to the desired temperature regularly happens via Joules transfer from within an electrical resistance wire.
- The transfer of Joules happens intensively between the internal channels and/or free passages of the heat accumulator and the fog liquid flowing through.
- All the evaporated fog liquid is emitted into the "area to be fogged" via an outlet channel and a nozzle and to immediately condense into a dispersed aerosol-like fog under atmospheric pressure and room temperature.

Figure 1:
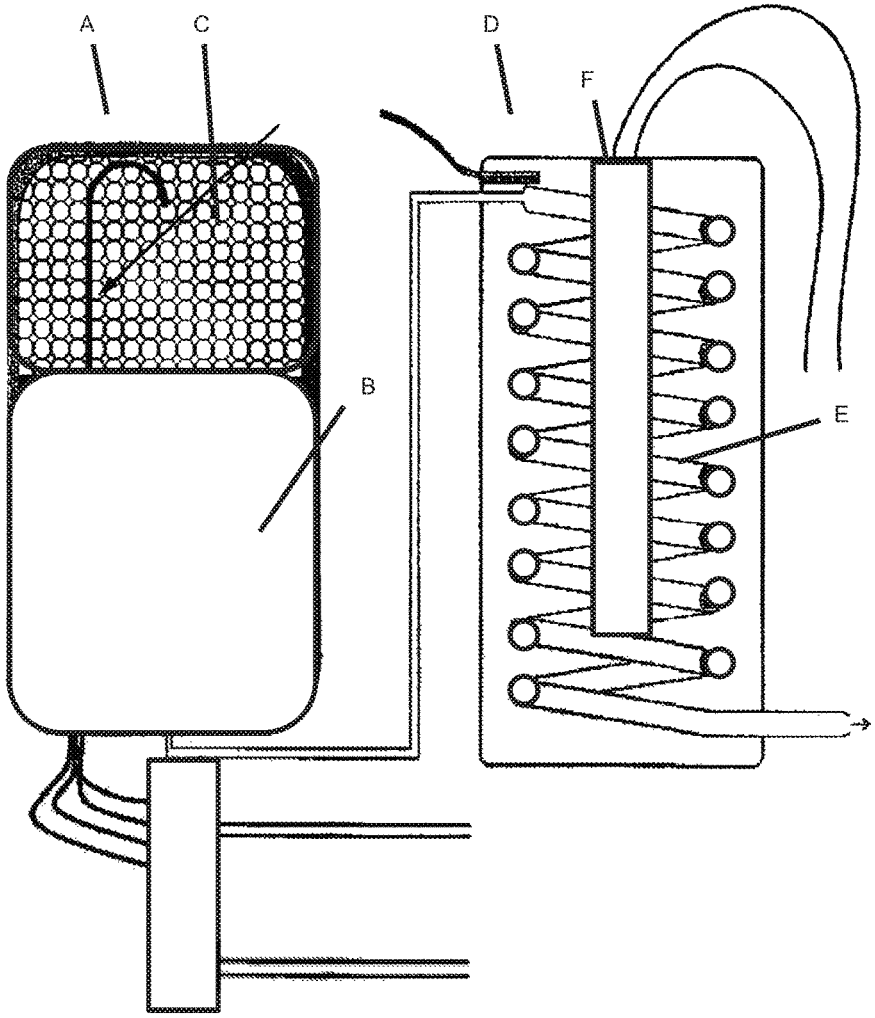

The fog generation capacity (debit ml/sec) of a heat accumulator strongly depends on the fog liquid supply pressure offered at its inlet and its design. In prior art fog generators, the heat accumulator is provided with a channel or a few channels that is/are kept at high temperature (FIG. 1). The fog liquid is vaporized by driving it through the hot channel. The speed of the fog formation is naturally crucial for fog generators for security applications. The current innovations in the field are then also directed at accelerating the speed at which fog is generated (both the speed of the commencement of fog formation and the volume of fog emitted per second). So, for instance, a fog generator is represented in PCT/EP2013/078112, in which a fog liquid is ejected by means of the gas generation out of a pyrotechnic substance. The fog liquid can also be driven out by a compressed/liquid propellant under high pressure (eg. 80 bar). However, it has been established that prior art heat accumulators do not work work optimally for such an, as it were explosive, forcing in of the fog liquid. Because the debit in fog liquid is quickly 10× larger than in current devices, such heat accumulators cannot completely vaporize the liquid, mostly because of insufficient optimally transferable Joules being available at the heat transfer surface during the time that the fog liquid flows through. Consequently, not only gas but also fog liquid is expelled via the exit.

PCT/EP2013/078112 offers a solution thereto by offering a plate heat accumulator with labyrinth-design (FIG. 2), this development facilitates quick heat transfer but also forms a relatively large dynamic resistant (due to the relatively long route to be covered by the liquid to be vaporized). A pressure drop between the inlet and the outlet of the heat accumulator of 50 bar is to be expected in case of a debit of 100 ml fog liquid per second. Although this pressure drop is not that problematic, because of the initial high pressure (80 bar and higher), this heat accumulator has a few further disadvantages. For example, the heat accumulator is cumbersome to produce. The plates have to be pre-formed and welded to each other individually.

However, warping of the plates due to the addition of small distortions during and after the post-shrinking of the welded components showed to be an even greater problem. The sum of all the undesirable distortions is difficult to keep under control even under an axial press, this, due to the quick transition from hot to cold of the plates installed first in respect of the inlet when the liquid is injected, leads to unpredictable clicking. Moreover, it is costly and difficult to design the heat accumulator in a corrosion-resistant manner. Especially this is really important for a heat accumulator in a fog generator, in view of the high temperatures and the oxygen entering from the atmospheric environment (normally entering from the nozzle or as a result of the available oxygen from the thermal end reaction), resulting in the "corrosive" acidity level of the thermal degradation products of the liquids used.

Consequently, there is a need for a heat accumulator for a fog generator that can completely vaporize a large debit of fog liquid and that is resistant to a high operating pressure, simple to produce at a low cost and that can be properly designed corrosion-resistant.

DESCRIPTION OF THE INVENTION

The heat accumulator for vaporizing fog liquid in a fog generator according to the invention comprises multiple closely contiguous, densely (closely) stacked, parallel oriented round rods. The diameter of the rods is preferably between 0.2 mm and 15.0 mm. In a further embodiment, the rods have a diameter of between 0.5 mm and 5 mm, especially between 0.5 mm and 3.0 mm. In a certain embodiment, to rods comprise a massive metal core, such as steel, iron, copper, aluminium, or metal alloys. The rods, in a further embodiment, at least partially consist of a corrosion-resistant material. Corrosion, for example, can be avoided by applying a corrosion-resistant layer to steel or copper rods, or the rods can partially or entirely consist of stainless steel or ceramic- or carbon-comprising materials, in particular stainless steel.

The rods may also consist of relatively thick-walled (hollow) tubes, wherein the passage section (inner section) of the tube is small, preferably equal to or smaller than the passage section (A of FIG. 7) of an optimal channel formed by a hexagonal stacking of the tubes and corresponding with the opening between 3 perfectly stacked rods. If the inner sections of the tubes are big, for example, bigger than the passage section of an optimal channel, these internal hollows in the tubes may become constricted/suppressed by beads, as explained elsewhere in the application. The rods are preferably not hollow.

In another embodiment, the rods are located in a container and the internal volume of the container is filled with rods for more than 50%, in particular more than 70%, preferably more than 75%, and more in particular more than 80%. In practice, it has been established that by using rods of, for example, 1.4 mm in diameter, more than 80% of the space in the container can be taken up by the volume of the rods. Preferably, the heat accumulator according to the invention comprises a distribution agent. The distribution agent divides/distributes the fog liquid over the section close to the inlet of the heat accumulator. Any distribution agent may be used. In this way, the entrance of the heat accumulator can be designed such that the incoming liquid is distributed over multiple channels and/or there can be a distribution disc wherein holes ensure a uniform distribution. It is also possible to, for example, provide a layer of pearls through which the fog liquid is distributed and, in this way, flows between the rods in a more homogeneous manner.

Similar to the distribution agent that is located in the vicinity of the inlet of the heat accumulator, it is also possible to provide collection means in the vicinity of the outlet. The collection means can help to collect all the gas that formed, for example, in a single outlet channel in the heat accumulator.

In another preferred embodiment, the heat accumulator according to the invention comprises inert beads around and/or amongst the rods. The inert beads may be made of any material, as long as it is compatible with the pressure and temperature in the heat accumulator and with the contact with the fog liquid. For example, they can be made of thermo resistant plastic or ceramic or carbon containing materials, or of materials that contribute more to the heat capacity of the heat accumulator, such as, for example, metal. In a preferred embodiment, they consist of corrosion-resistant metal, such as stainless steel. In a preferred embodiment, the average diameter of the beads is larger than 0.16 times the diameter of the rods.

The current invention also provides a method to generate a dense, opaque fog, the method comprising the following steps:

- heating the heat accumulator according to one of the previous claims;
- introducing a fog generating liquid into the heat accumulator via an inlet in the heat accumulator, whereby the fog generating liquid is converted into its gaseous form; and
- letting the gas obtained flow out via an outlet of the heat accumulator through which it generates a dense, opaque fog as soon as it gets in the atmospheric environment.

The current invention also provides a fog generator comprising a reservoir that comprises a fog generating liquid and a heat accumulator according to one of the embodiments of he current invention. The reservoir for the fog generating liquid can be incorporated in the fog generator either as replaceable or as irreplaceable.

In a certain embodiment, the current invention provides for a heat accumulator as described herein in combination with a reservoir for fog liquid as described in the European patent application with application number EP14163988, filed on 9 Apr. 2014. In other words, the current invention also provides the embodiments of the invention described in said European application, in which the heat accumulator according to the current application is used instead of the generically referred-to heat accumulator in EP14163988 (in that application referred to as a heat exchanger). The inventor actually discovered that such a reservoir in combination with the heat accumulator according to the invention works synergistically. In prior art fog generators, the fog liquid is in contact with a gas, e.g., a propellant. Due to this, the propellant is partially dissolved in and/or mixed with the fog liquid. The turbulence is increased by the expansion of these gas bubbles in the heat accumulator. This is viewed as beneficial in the prior art in order to increase the contact with known heat accumulators and, as such, to obtain a better fog outflow. On the other hand, the inventor discovered that such fog liquid with dissolved and/or mixed gas bubbles does not have a positive effect on the fog outflow obtained with a fog generator according to this invention. On the contrary, it was surprisingly discovered that the fog outflow with the heat accumulator according to the invention, actually improves by separating the fog liquid from the propellant, for example, by using a movable wall, such as a piston, in the reservoir comprising the fog liquid, as described in EP14163988. Without wishing to be bound to theory, is seems as if the gas bubbles in the current heat accumulator, with the many small channels, disrupt a uniform boiling front and thereby hinder a very regular outflow. It should be noted that the current heat accumulator works very well with prior art liquid reservoirs, but that a combination with a liquid reservoir with a separation between the gas and fog liquid by means of a movable wall provides an additional benefit in the form of a more regular outflow and an even faster vaporization of the fog liquid.

The current invention therefore offers a heat accumulator in combination with a reservoir comprising a fog-generating liquid on a first side of a movable wall and a propellant on a second side of a movable wall. The invention also comprises a housing and/or a fog generator comprising such a combination and the use of such a combination/housing/fog generator for the uses and methods discussed in this application.

SHORT DESCRIPTION OF THE DRAWINGS

FIG. 1: Prior art fog generator (described in EP1985962)

Figure 2:
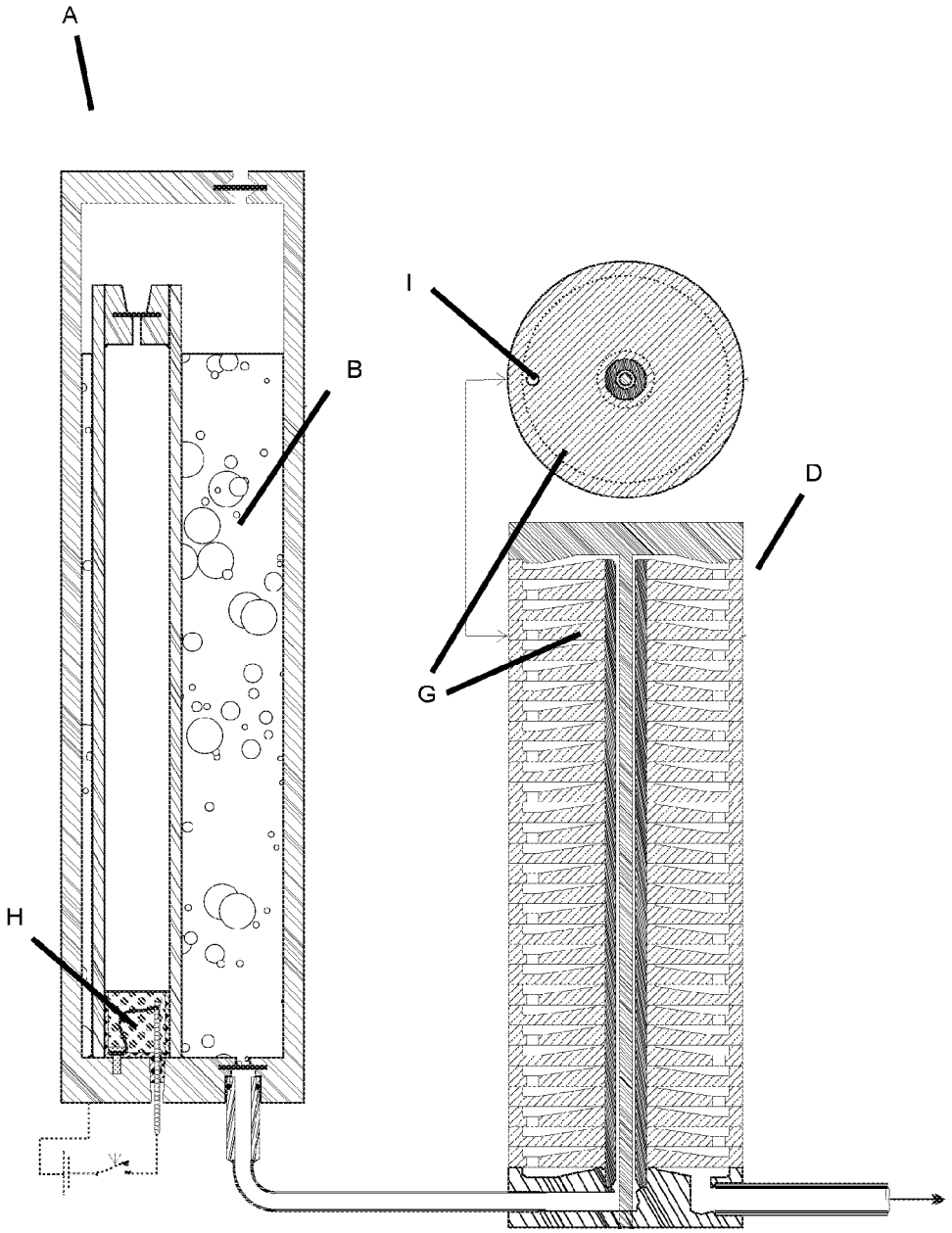

FIG. 2: Improved fog generator described in PCT/EP2013/078112 (not prior art)

Figure 3:
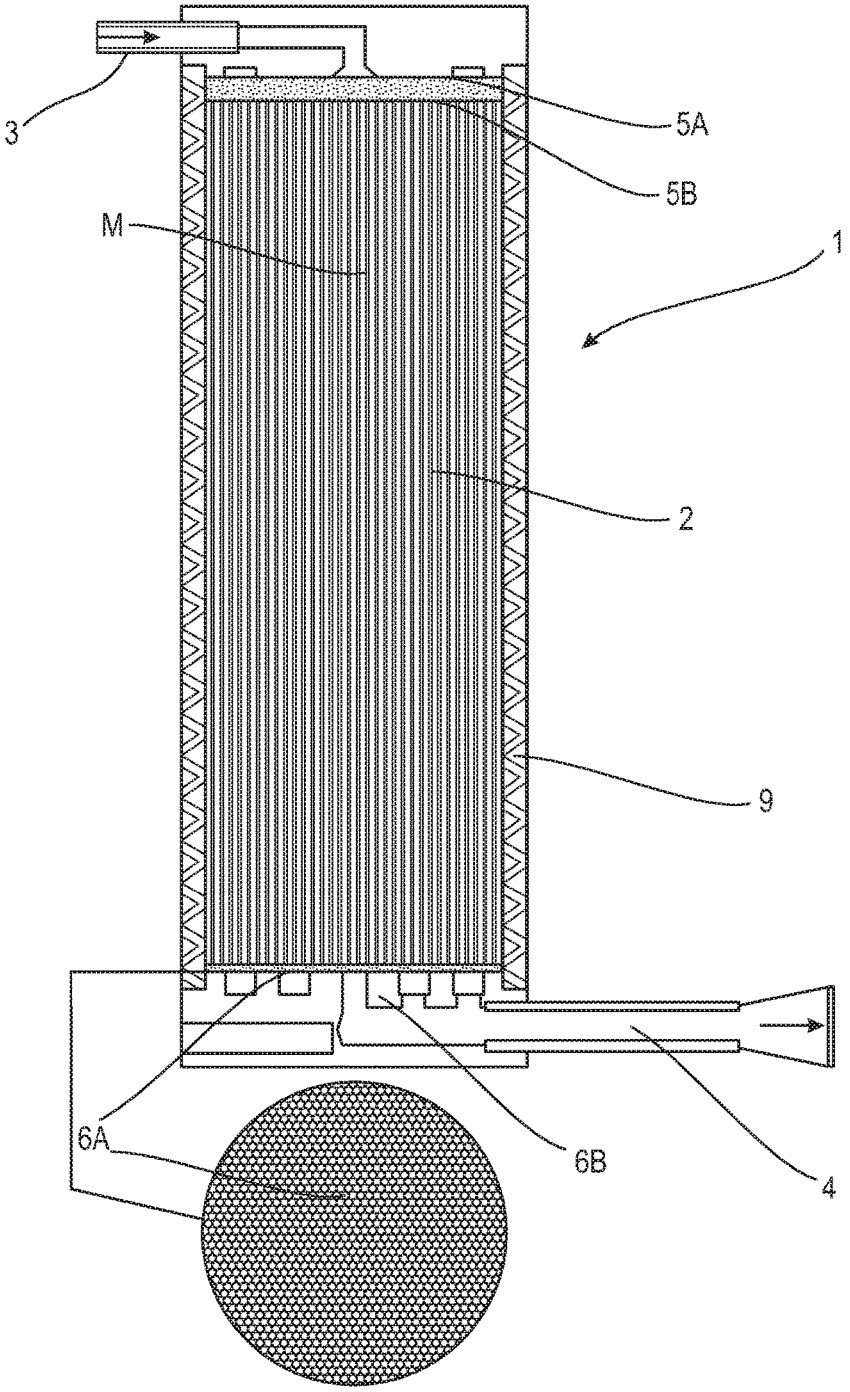

FIG. 3: Fog generator according to the invention: cross-section parallel to the rods FIG. 4: Fog generator according to the invention: cross-section perpendicular to the rods FIG. 5: Fog generator according to the invention: detail of cross-section perpendicular to the rods FIG. 6: Detail of cross-section of optimally stacked rods As has already been described herein, a prior art fog generator comprises (FIG. 1) a reservoir (A) comprising the fog-generating liquid (B). This liquid is driven, for example by a pump or propellant (C), to a heat accumulator (D) that comprises (a) channel(s) (E) surrounded by thermal retention material heated by a heating element (F). This liquid is converted into its gaseous phase when flowing through the channel(s). When the gas is ejected, a dense fog is formed due to its subsequent condensation in the atmosphere.

An improved heat accumulator, which can better deal with the higher debit in fog liquid vaporization, is represented in FIG. 2 (PCT/EP2013/078112). This also comprises a reservoir (A) with fog generating liquid (B). This is driven by gas generated after the ignition of a pyrotechnic substance (H). The heat accumulator (D) comprises multiple stacked plates (G). The plates have a passage (I). The connected stacking of these passages makes the fog liquid follow a "labyrinth path". As such, the liquid comes extensively into contact with practically the entire surface of the hot plates and, in this way, is converted into its gaseous form. The heat accumulator from PCT/EP2013/078112 is characterised by the following data: approximately 70% of the internal space is filled with the plates (193 ml plates in respect of 82 ml free volume) and there is a touching surface between the plates and the liquid flowing through of approximately 11 $dm^2$ (surface available for heat exchange).

Figure 4:
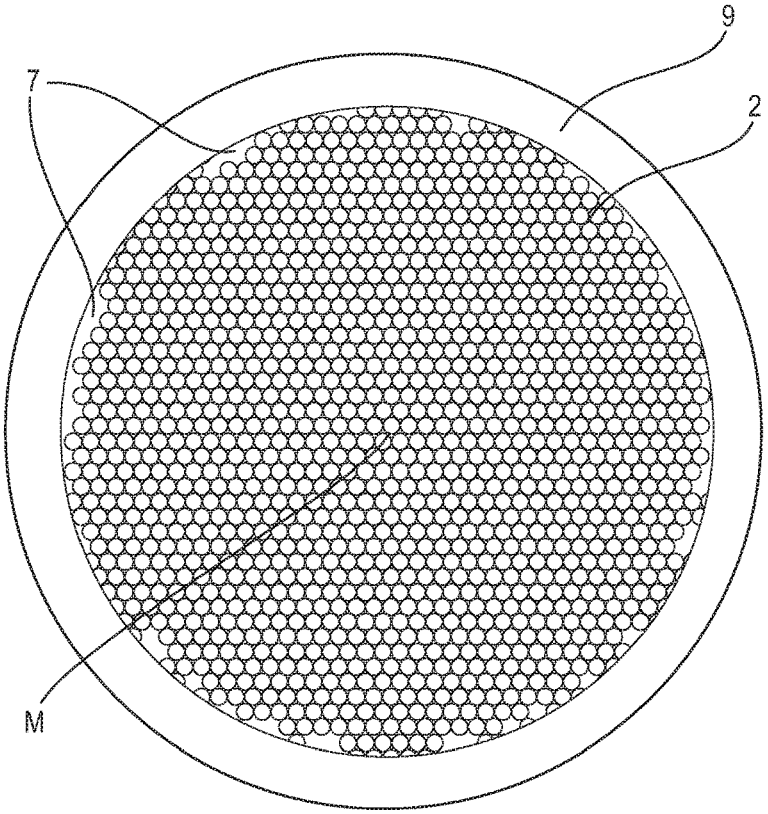
Figure 5:
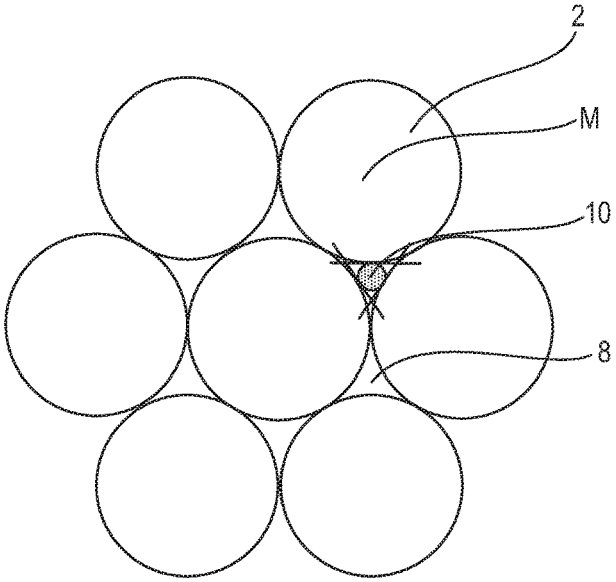

FIGS. 3 and 4 show a certain embodiment of the heat accumulator according to the invention (1). The heat accumulator comprises multiple closely contiguous, parallel oriented rods (2). The fog liquid enters the heat accumulator via the inlet (3) and flows through the rods, due to which it is heated and converted into the gaseous phase. The gas leaves the heat accumulator via the outlet (4). There is a distribution agent (5) at the inlet, in this case a terminal plate in the form of braided mesh (5*a*) (woven mesh). Moreover, there is a layer of inert beads (5*b*) at the top that facilitates further distribution. There are also collection means (6) at the outlet, here comprising a layer of braided mesh (6*a*) and a collection plate (6*b*), which combines multiple channels into a single outlet channel.

In a practical embodiment with 1100 rods of 1.4 mm in diameter and 146 mm in length, manufactured from stainless steel (AISI 430), the outer surface of the rods is approximately 71 $dm^2$ (surface available for heat exchange).

The container with an internal volume of 288 ml, is then filled up 247 ml (83.5%) with rods and there is remaining free volume of 41 ml (16.5%). The total weight of the heat accumulator can, in this way, be limited, inclusive of rods (1925 g), bottom (270 g), cover and disks (252 g) and container (850 g) to only about three kilogram and this with a minimal total volume. The heat accumulator is preferably cylindrical, as this form is optimal in respect of thermal isolation and pressure resistance. The rods are preferably hexagonally stacked. More in particular, the rods are straight rods in a parallel orientation. A least 7 rods are required for hexagonal stacking, but at least 20 rods are preferably used. These quantities are needed to obtain a high density (herein also referred to as stacking density or filling percentage). In a particular embodiment, at least 100, more particularly 200 and in especially at least 500 rods are used.

Although a theoretical stacking density of pi/(12^0.5)=0.9 can be obtained in case of optimal circle stacking (hexagonal stacking or hexagonal circle packing), it is lower in practice. As FIG. 4 shows, there is always a space into which no further rod fits (7), which will reduce the density. This disorder in the stacking cannot be avoided in practice and may result in "cold channels" throughout the heat accumulator. After all, liquid that flows through non-optimal channels, relatively seen, has a too large debit and cannot be fully converted into its gaseous form. However, it should be stressed that this cold channel formation and discharge of non-vaporised liquid is much more restricted than in case of a prior art heat accumulator as in FIG. 1. The heat accumulator described above can, without further modification, perform adequately and is suitable to vaporize liquid under high pressure and with a high debit.

A solution against non-optimal channels is filling up these non-optimal channels by inserting rods with a suitable diameter (Apollonian packing). However, this is difficult to perform in practice because the locations, form and section size of the non-optimal channels in the production environment are difficult to predict, and it is cumbersome and error-prone to try and detect these via vision or optical sensors. Another way is to shape the inner wall of the cylinder (container) along the longitudinal direction (eg. extruded tube) in such a way that the hexagonally stacked rods fit with their stacking pattern to this wall. For example, longitudinal protuberances, cavities or polygon ribs may be provided to which to rods can closely connect. In this case, the wall is preferably implemented as such that the section of a channel that is formed between the wall and the adjacent stacked rods is always smaller than or equal to the section A (FIG. 7) of an optimal channel (a channel formed between 3 perfectly stacked rods). However, the inventor has established that the heat accumulator according to this invention can be improved further very simply and cheaply. Inert beads can be introduced after the rods have been introduced, as compactly as possible, into the container in the heat accumulator. They preferably have a diameter that is so large that they cannot end up between perfectly stacked rods (with optimal channels between them), but can in the areas where there is no perfect stacking (the so-called "non-optimal channels", 7). The beads constrict the non-optimal channels and prevent these from still forming channels with an abnormally high flow "cold channels", while keeping the optimal channels between the perfectly stacked rods (8) completely free for the passage of the fog liquid. "Optimal channels", in this application refers to channels that are formed by three rods. Non-perfect channels are formed by at least four rods or are partly formed by the inner wall of the cylinder (wall); these are described as "non-optimal channels" in this application.

An especially practical method for producing a heat accumulator according to the invention is to disseminate beads on top of the rods after introducing them in the container (e.g. a cylindrical tube (9) as shown in FIGS. 3 and 4). By, for example, vibrating it entirely, the beads will fall into all the spaces where they fit in (the inscribed circle within the non-optimal channels). It was established that only about six grams of beads with a diameter of 0.3 mm are required for a kilogram of rods with a diameter 1.4 mm. Moreover, by disseminating an abundance of beads, a layer of beads is created on top of the rods (5*b*). These can be removed, but can also be used as distribution agent. A preferred embodiment of the heat accumulator according to the invention also comprises a filter agent; this to prevent the beads from flowing out of the container. Such filter agent can be located in close proximity of the inlet and/or the outlet. The filter agent can be the same as or different to the distribution agent. An example is using braided mesh (5*a* and 6*a*) at the top and bottom of the container.

Figure 6:
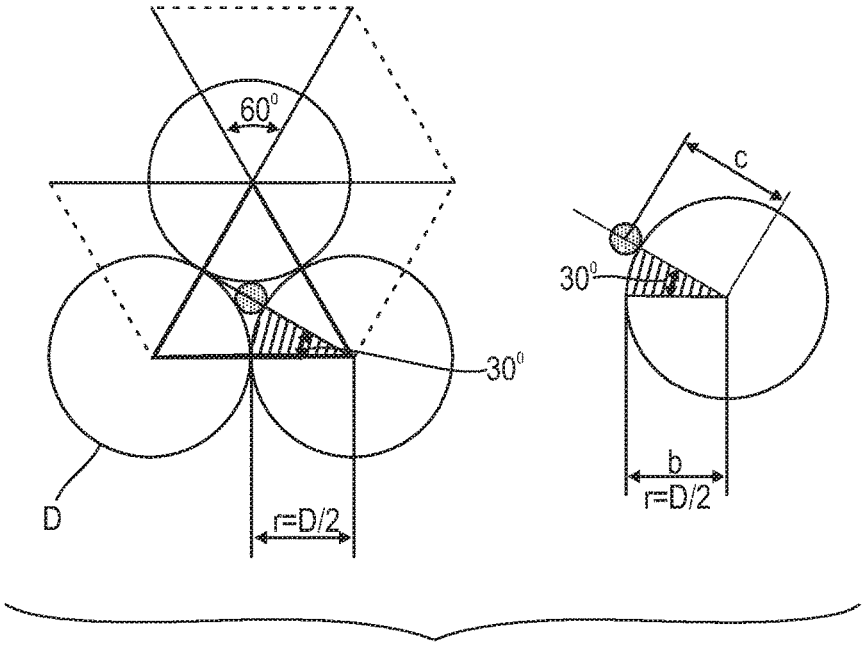

The diameter of the inscribed circle (10) between the three perfectly stacked rods can be calculated as follows. The sum of the radius of the inscribed circle (r2) and the radius of the rod (r1) forms the hypotenuse (c) in a rectangular triangle with a rectangular side that is the radius of the rod (FIG. 6). The angle between this hypotenuse (c) and the rectangular side (b), within a hexagonal stacking, is always 30°. The hypotenuse (c) then has a length of b/cos(30°. Thus, r1/(r1+r2)=)cos(30°), or r2 is r1*(1/cos(30°)−1). Therefore, the ratio between the radius of the rods (r1) and the radius of the inscribed circle (r2) is approximately 1 to 0.1547; this ratio of course also applies to the diameters and the inscribed circle. Beads with a minimum diameter of more than 0.16 times the diameter of the rods are therefore used in a preferred embodiment. Thereby, the optimal channels (spaces between the optimally stacked rods) are not filled with the beads, but the beads actually occupy the non-optimal channels (channels with an inscribed circle that is larger than the diameter of the beads).

In other words, the design choice with regard to the diameter of the rods corresponds with a proportional minimal diameter of the filler beads. The invention therefore allows for setting the channel parameters accurately in a very simple way. In a further embodiment, beads are used with a diameter between 0.16 and 0.7 mm, in particular between 0.16 and 0.5, and more in particular between 0.16 and 0.3 times the diameter of the rods.

The section of an optimal channel, located between the three rods with the same diameter, can be calculated by reducing the area of the triangle from FIG. 6 with half of the area of the section of the rods. Therefore, the section A is (see FIG. 7):

$$\frac{D*\left(D*\sqrt{\frac{3}{2}}\right)}{2}-\frac{\pi*\left(\frac{D^2}{4}\right)}{2}$$

with D being the diameter of the rods. It is of course also possible to use rods with different diameters, although the section of optimal channels (formed by only three rods) then no longer complies with the formula above. Rods with the same diameter are used in a preferred embodiment.

The beads can be made from a material that contributes or doesn't contribute to the heat capacity of the heat accumulator. The material of the beads is preferably a material that contributes to the heat capacity, such a metal beads. The beads can be of any shape, but are substantially spherical in a particular embodiment. The beads preferably comprise, at least partially, a corrosion-resistant material. The beads comprise stainless steel in a particular embodiment. In another embodiment, the beads comprise a metal core surrounded by a corrosion-resistant layer.

The heat accumulator according to this invention is very simple to produce and does not require any welding of the material that takes care of the heat storage and transfer. Moreover, it can be produced cheaply with a good corrosion resistance. Stainless steel coil material can, for example, be used for producing the rods. This material is easy to use and cheap and it can simply be cut to the desired length. Very little material is required (a few gram per heat accumulator) if beads are used. Moreover, stainless steel beads of 0.3 mm are very cheap to procure. Moreover, the heat accumulator allows for a particularly fast vaporization of an injected quantity of fog liquid under very high pressure thanks to its large heat exchange surface in relation to its weight and occupied volume.

The invention claimed is:

1. A heat accumulator suitable for vaporizing a liquid, the heat accumulator comprising:

multiple closely contiguous, parallel oriented, non-hollow rods with a diameter between 0.2 mm and 15 mm, comprising a metal core;

inert beads around and/or between the multiple closely contiguous, parallel oriented non-hollow rods, wherein an average diameter of the inert beads is larger than 0.16 times a diameter of the multiple closely contiguous, parallel oriented, non-hollow rods.

2. The heat accumulator according to claim 1, wherein the multiple closely contiguous, parallel oriented, non-hollow rods have a diameter of between 0.5 mm and 5 mm.

3. The heat accumulator according to claim 1, wherein the multiple closely contiguous, parallel oriented, non-hollow rods at least partially comprise of corrosion-resistant material.

4. The heat accumulator according to claim 1, wherein the multiple closely contiguous, parallel oriented, non-hollow rods are located in a container, said container having an internal volume filled for more than 70% by the multiple closely contiguous, parallel oriented, non-hollow rods.

5. The heat accumulator according to claim 4, wherein the internal volume of the container, measured at the multiple closely contiguous, parallel oriented, non-hollow rods, is filled for more than 75% by the multiple closely contiguous, parallel oriented, non-hollow rods.

6. The heat accumulator according to claim 1, wherein the multiple closely contiguous, parallel oriented, non-hollow rods are stacked hexagonally.

7. The heat accumulator according to claim 1 comprising at least 7 of the multiple closely contiguous, parallel oriented, non-hollow rods.

8. The heat accumulator according to claim 1, further comprising a distribution agent.

9. A method for vaporizing a liquid, the method comprising:

heating the heat accumulator according to claim 1;

introducing a liquid via an inlet into the heat accumulator, whereby the liquid is converted into a gaseous form; and letting the gas obtained flow out via an outlet of the heat accumulator.

10. The method of claim 9, wherein the liquid is a fog generating liquid, and wherein the gas generates a fog as soon as it gets in the atmospheric environment.

11. A fog generator comprising a reservoir that comprises a fog generating liquid and a heat accumulator according to claim 1.

12. The fog generator according to claim 11, wherein the reservoir comprising the fog generating liquid comprises a movable wall with the fog generating liquid on a first side of the movable wall and a propellant on a second side of the movable wall.

* * * * *